US008910382B2

(12) United States Patent
Takahashi

(10) Patent No.: US 8,910,382 B2
(45) **Date of Patent: *Dec. 16, 2014**

(54) RING MANUFACTURING METHOD, APPARATUS OF THE SAME AND RINGS MANUFACTURED BY THE RING MANUFACTURING METHOD

(75) Inventor: Masaki Takahashi, Tokyo (JP)

(73) Assignee: Mokumeganeya Co., Ltd., Tokyo (JP)

( * ) Notice: Subject to any disclaimer, the term of this patent is extended or adjusted under 35 U.S.C. 154(b) by 138 days.

This patent is subject to a terminal disclaimer.

(21) Appl. No.: 13/594,178

(22) Filed: Aug. 24, 2012

(65) Prior Publication Data

US 2013/0047667 A1 Feb. 28, 2013

(30) Foreign Application Priority Data

Aug. 25, 2011 (JP) ..... 2011-183652

(51) Int. Cl.

| | |
|---|---|
| ***A44C 9/00*** | (2006.01) |
| ***B21D 53/44*** | (2006.01) |
| ***B21F 37/00*** | (2006.01) |
| ***B21J 1/00*** | (2006.01) |

(52) U.S. Cl.

CPC ..... *B21F 37/00* (2013.01); *B21J 1/003* (2013.01); *A44C 9/00* (2013.01)

USPC ..... 29/896.412; 29/8; 29/896.41; 63/15; 63/15.1; 72/367.1

(58) Field of Classification Search

CPC ..... A44C 9/00; A44C 9/0023; B21D 11/14; B21F 37/00; B21J 5/00; B21K 1/761; B32B 15/01; B32B 15/018

USPC ..... 29/8, 896.41, 896.412; 63/15, 15.1, 63/15.2, 15.7; 72/367.1

See application file for complete search history.

(56) References Cited

U.S. PATENT DOCUMENTS

| | | | | | |
|---|---|---|---|---|---|
| D89,240 | S | * | 2/1933 | Kagan | D11/37 |
| 4,270,528 | A | * | 6/1981 | Hanson | 602/22 |
| 4,307,502 | A | * | 12/1981 | Scola | 29/896.412 |
| 4,362,031 | A | * | 12/1982 | Obermuller | 63/15 |
| 8,661,682 | B2 | * | 3/2014 | Takahashi | 29/896.412 |
| 2012/0079720 | A1 | | 4/2012 | Takahashi | |

FOREIGN PATENT DOCUMENTS

| | | | | | |
|---|---|---|---|---|---|
| DE | 10020274 | A1 | * | 10/2001 | A44C 9/00 |
| EP | 2436457 | A1 | * | 4/2012 | |
| FR | 0762489 | A1 | * | 10/1998 | A44C 27/00 |
| JP | 06078814 | A | * | 3/1994 | A44C 9/00 |
| JP | 4642153 | B1 | | 3/2011 | |
| WO | WO 9906174 | A1 | * | 2/1999 | B23P 15/00 |

* cited by examiner

*Primary Examiner* — Alexander P Taousakis

(74) *Attorney, Agent, or Firm* — Birch, Stewart, Kolasch & Birch, LLP

(57) ABSTRACT

Form the oval rings 25 from the circular rings 23. Then, twist the oval rings 25, for instance three times, around center of the longitudinal direction, and create the ring portion for male 31 and the binding portion at the both side of the binding portion. After that, obtain the rings for male 2 and the rings for female 3 by cutting the binding portion.

6 Claims, 9 Drawing Sheets

FIG. 5A ST19
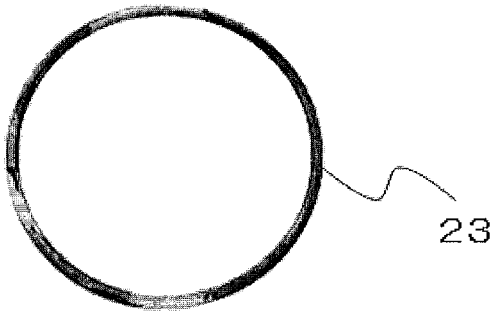
FIG. 5B ST20
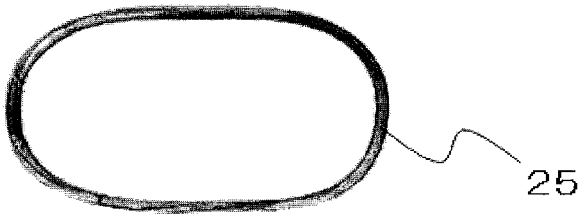
FIG. 5C ST21
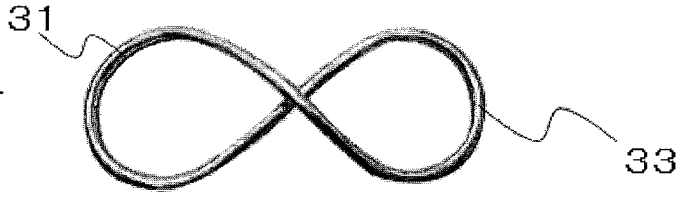
FIG. 5D ST22
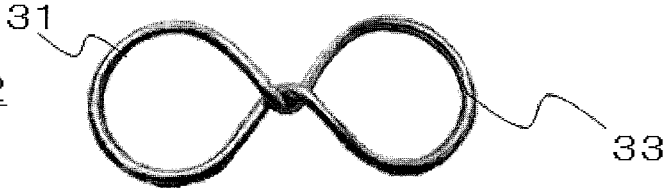
FIG. 5E ST23
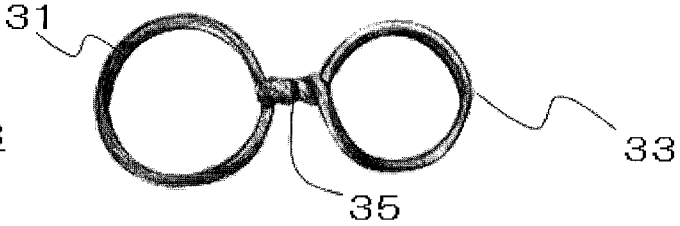

RING MANUFACTURING METHOD, APPARATUS OF THE SAME AND RINGS MANUFACTURED BY THE RING MANUFACTURING METHOD

FIELD OF INVENTION

The present invention relates to a ring manufacturing method, which forms two rings by processing the metal body, an apparatus of the same and a ring manufactured by the ring manufacturing method.

BACKGROUND

Mokumegane is a special metal working technology which Japan is proud of in the world. The special processing process exceeds the frame of mere technology, and reaches even an ideological and mental domain called the dialog of a material and a producer.

After carrying out the lamination and joint of the metal plates with different colors and twist processing, the surface is carved by chisel or the trill-like tool, then "mokume" patterns are formed on the surface by forging into plate with hammer.

By the way, when manufacturing rings of the pair by the Mokumegane technique, there are some requests for forming a common feature pattern.

Conventionally, the metal plate is laminated two or more metal plates, and obtained from the twist processing step. And the metal plate is cut into two, the rings are created by processing each metal plates.

According to the manufacturing method of the ring of the prior art, two rings obtained from one metal plate have common characteristic pattern formed by Mokumegane techniques.

PROBLEMS TO BE SOLVED

By the way, aforementioned products such as rings of the pair, the design strongly reminiscent concept that the rings are born (made) from the same one thing is required.

An object of the present invention is to provide a ring manufacture method and the apparatus capable to manufacture rings with the design strongly reminiscent concept that the rings are produced (made) from the same one thing and rings manufactured by the ring manufacture method.

SUMMARY OF THE INVENTION

A first invention is a ring manufacturing method comprising: a ring formation step processing a circular member of a ring shape to form a first ring and a second ring; and a cut step cutting a binding portion at a point between the first ring and the second ring.

Preferably the ring manufacturing method of the first invention further comprises: a oval formation step forming an oval-formed member, wherein the ring formation step twists the oval-formed member near a center of a long distance direction and forms the first ring and the second ring on both sides of the binding portion which occurred by the twist.

Preferably the ring formation step of the ring manufacturing method of the first invention twists the circular member a plurality of times.

Preferably the ring formation step of the ring manufacturing method of the first invention twists the oval-formed member near a center of a long distance direction while pulling both sides of the oval-formed member to the direction that the first ring and the second ring separate mutually.

Preferably the ring manufacturing method of the first invention further comprises a oval formation step forming an oval-formed member, and the ring formation step joins portions near a center of a long distance direction of the oval-formed member by pressing the portions near the center of the long distance direction of the oval-formed member to form the first ring and the second ring at both sides of a conjunction portion, and the cut step cuts the conjunction portion.

Preferably the ring manufacturing method of the fist invention further comprises: a lamination step laminating a plurality of metal plates; a junction step joining the plurality of metal plates laminated in the lamination step by heating; a twist step twisting the plurality of metal plates joined in the junction step; a flat step processing the plurality of metal plates into a flat shape after the twist step; and a formation step processing the metal plates formed in the flat step to form a single ring.

A ring manufacturing apparatus of the second invention comprises: a ring formation means for processing a circular member of a ring shape to form a first ring and a second ring; and a cutting means for cutting a binding portion of the first ring and the second ring.

A ring of the third invention is manufactured by: a ring formation step processing a circular member of a ring shape to form a first ring and a second ring; and a cut step cutting a binding portion at a point between the first ring and the second ring.

BRIEF DESCRIPTION OF DRAWING

FIG. 5A to FIG. 5E are drawings explaining the ring manufacturing method in the first embodiment of the present invention.

DETAILED DESCRIPTION OF THE INVENTION

Hereinafter, embodiment of the present invention will be explained by using drawings.

In the present embodiment, the case of manufacturing a ring for male (an example of the first ring of the present invention) and a ring for female (an example of the second ring of the present invention) by Mokumegane techniques will be explained.

First Embodiment

Figure 1:
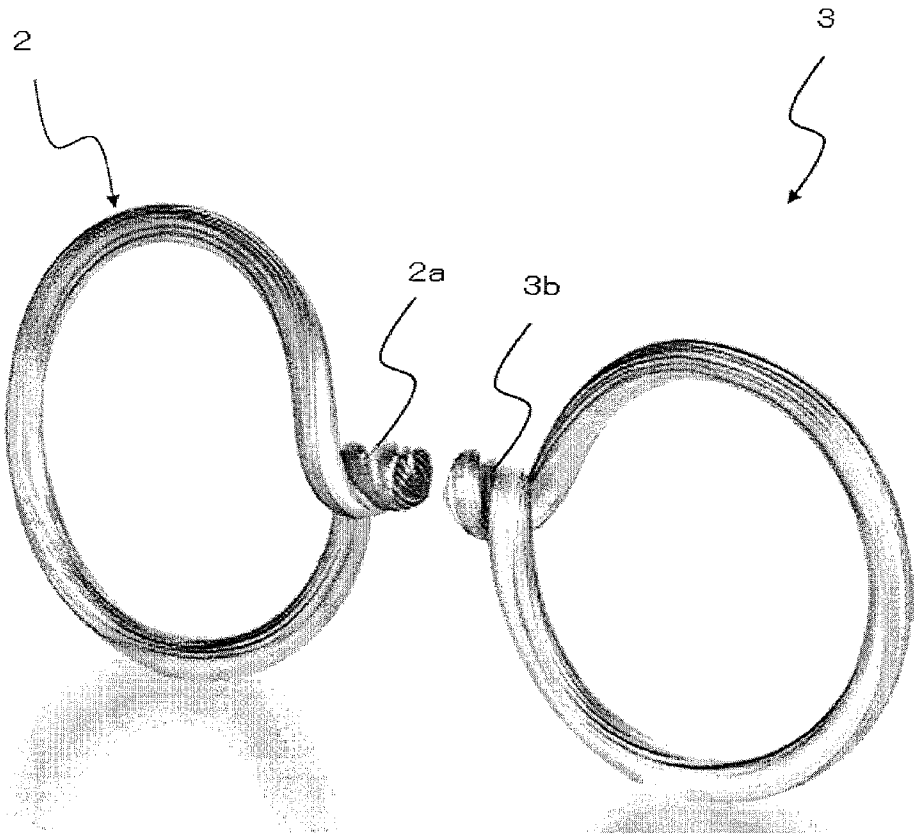
FIG. 1 is a perspective view of a ring for male and a ring for female manufactured by the ring manufacturing method in the first embodiment of the present invention.

FIG. 1 is a perspective view of the rings for male 2 and the rings for female 3 manufactured by the ring manufacturing method described in the first embodiment of the present invention.

Figure 2A:
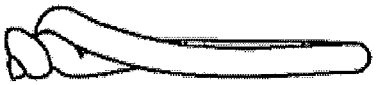
FIG. 2A is a front elevational view of a ring for male shown in FIG. 1.
Figure 2B:
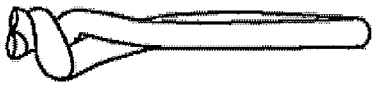
FIG. 2B is a rear elevational view of a ring for male shown in FIG. 1.

FIG. 2A is a front view of the rings for male 2 shown in FIG. 1. FIG. 2B is a rear view of the rings for male 2 shown in FIG. 1.

Figure 3A:
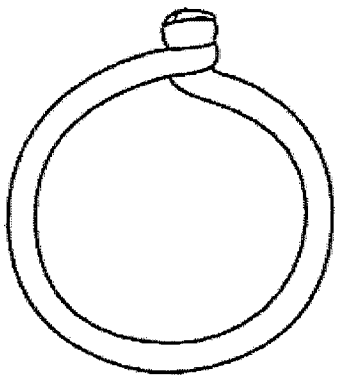
FIG. 3A is a right side elevational view of a ring for male shown in FIG. 1.
Figure 3B:
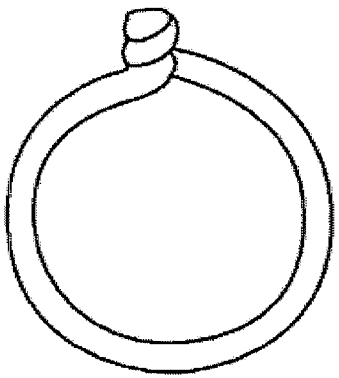
FIG. 3B is a left side elevational view of a ring for male shown in FIG. 1.

FIG. 3A is a right side view of the rings for male 2 shown in FIG. 1. FIG. 3B is a left side view of the rings for male 2 shown in FIG. 1.

Figure 4A:
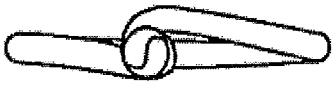
FIG. 4A is a top plan view of a ring for male shown in FIG. 1.
Figure 4B:
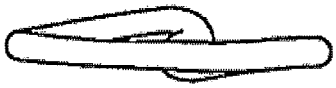
FIG. 4B is a bottom plan view of a ring for male shown in FIG. 1.

FIG. 4A is a top plan view of the rings for male 2 shown in FIG. 1. FIG. 3B is side view of the rings for male 2 shown in FIG. 1.

In the present embodiment, the oval rings 25 shown in FIG. 5B is formed from the circular rings 23 shown in FIG. 5A.

Then, as shown in FIG. 5C to 5E, twist the oval rings 25, for instance three times, around a center of the longitudinal direction of the oval-formed member, and create the ring 31 for male 2 and the binding portion 35 at the both side of the binding portion 35.

Then obtain the rings 31 for male 2 and the rings 33 for female 3 shown in FIG. 1 by cutting the binding portion shown in FIG. 5E.

Figure 6:
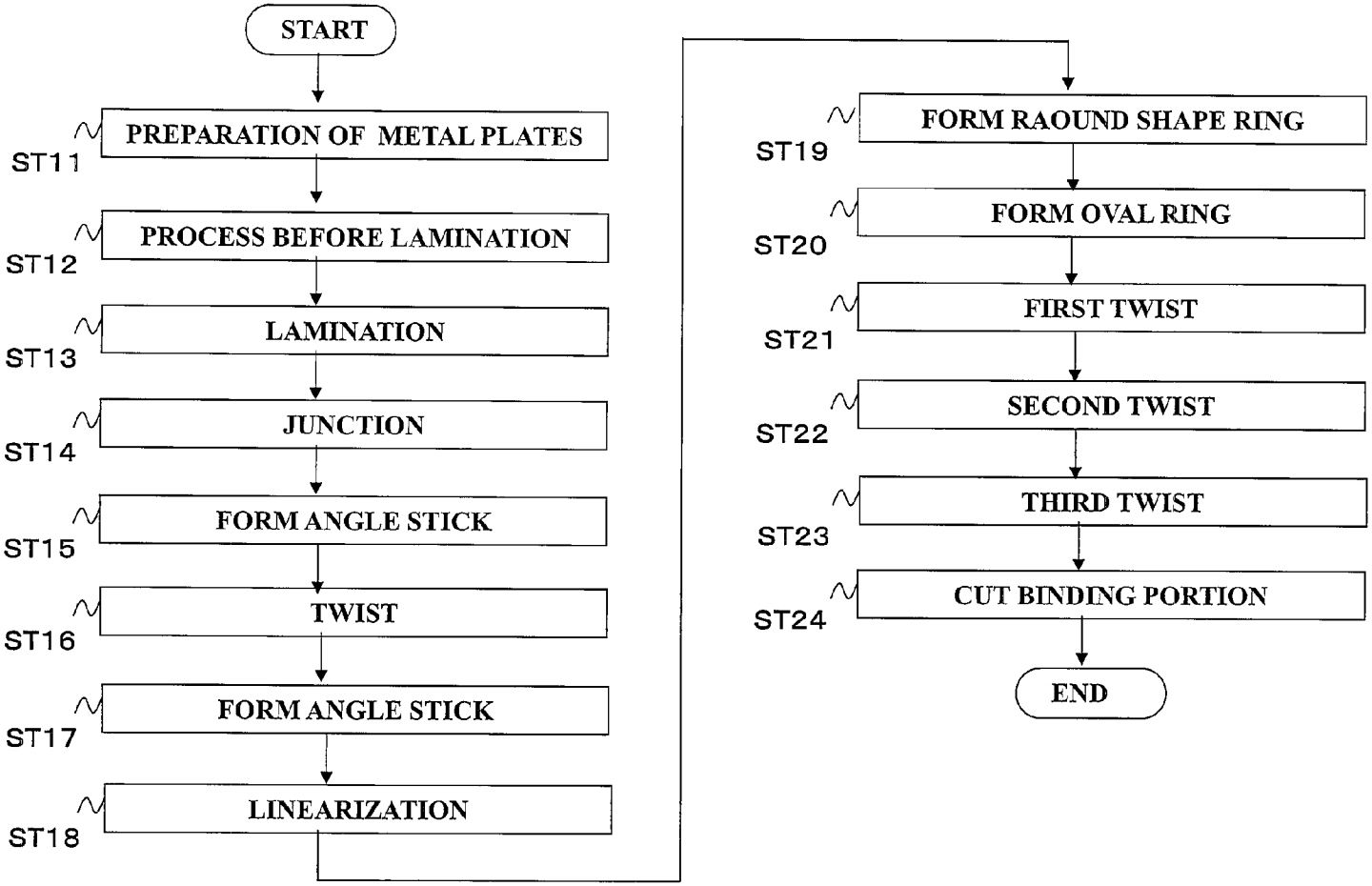
FIG. 6 is a flowchart of the ring manufacturing method relates to the first embodiment of the present invention.

FIG. 6 is a flowchart of a method of manufacturing ring relates to the embodiment of the present invention.

All or parts of the following steps are performed by hand or machine.

[Preparation Step of Metal Plates (Step ST11)]

Two or more metal plates with different quality of the materials are prepared. In this embodiment, 15 metal plates are prepared.

As the material of a metal plate, platinum (Pt), gold (Au), silver (Ag), copper (Cu), brass, titanium (Ti), iron (Fe), nickel (Ni), stainless steel, tantalum (Ta), or these mixtures are used.

Each metal plate consists of different materials with the character recognized visually, such as colors and degree of the gloss, differs. The thickness of the metal plates is approximately 0.1 to 1.0 mm. In addition, there should be at least two kinds of metal plates with different quality of materials. Moreover, more than two metal plates with same materials may be used among two or more metal plates.

[Step Before Lamination (Step ST12)]

Next, as pretreatment before junction, two or more metal plates are ground using sandpapers No. 600, No. 800, No. 1000, No. 1200, No. 1500 and so on. Then, charcoal grinding is used together and the surface is finished uniformly carefully.

[Laminating Step (Step ST13)]

Next, the multi-layered metal body (for example, laminated two or more metal plates of the present embodiment) is formed by laminating two or more metal plates and joining the (11) together.

Here, order of lamination is determined in consideration of a final design (feature pattern).

[Junction step (Step ST14)]

Junction of metal plats is performed by attaching the metal plates and giving pressure in a way in which the plastic deformation of the metal plate does not occur as possible in the temperature conditions below the melting point of the metal plate.

The conditions at the time of performing diffusion junction are as follows. Namely, it carries out by heating and pressurizing between 500 and 1200 degrees C. and between 200 and 500 kgf/cm2. In addition, junction of the metal plates can be performed using wax.

[Angle Stick Processing Step (Step ST15)]

Figures 7A, 7B, 7C:
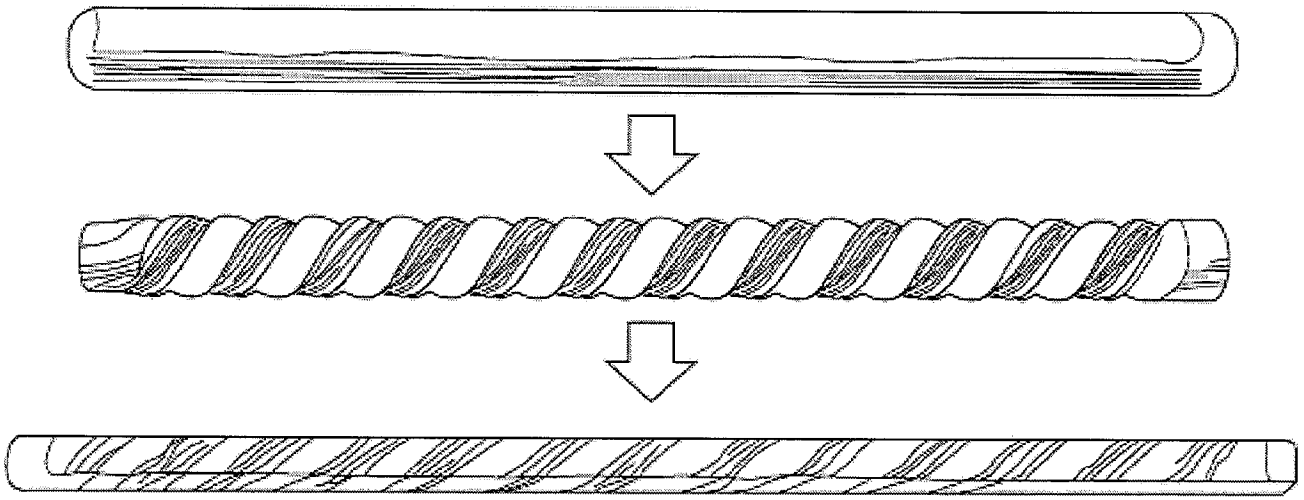
FIG. 7 is a drawing explaining steps shown in FIG. 6.

Next, after inspecting details and removing imperfect portion of the lamination, shown in FIG. 7A, spreading process is performed by using a roller to the angle stick shape, for example.

[Twist Processing Step (ST16)]

Then, reverse several times as shown in FIG. 7B from front, back, front, back, to perform twist process.

The forged angle stick is subjected to twist carefully and little by little with heating and annealing process while paying attention to lamination order. At this point, process of twisting with heating, process of cooling and process of annealing are repeated sequentially.

[Angle Stick Processing Step (ST17)]

As shown in FIG. 7C, the components after the twisting process are spread to the angle stick shape by using a roller.

[Linearized Process Step (ST18)]

Next, delineate and linearize the components with angle stick shape obtained in step ST17.

[Round Shape Ring Formation Step (step ST19)]

Then, form the circular rings 23 shown in FIG. 5A from the delineated component linearized in the step ST18.

[Oval Ring Formation Step (step ST20)]

Next, form the oval rings 25 shown in FIG. 5B from the circular rings 23 obtained in step ST19.

[First Twist Processing Step (step ST21)]

Then, as shown in FIG. 5C, the first twist processing step of the oval rings 25 is performed around the center of the longitudinal direction.

[Second Twist Processing Step (step ST22)]

Afterward, as shown in FIG. 5D, the second twist processing step of the oval rings 25 is performed around center of the longitudinal direction.

[Third Twist Processing Step (Step ST23)]

Next, as shown in FIG. 5E, the third twist processing step of the oval rings 25 is performed around a center of the longitudinal direction of the oval-formed member.

From this, the ring 31 for male 2 and ring 33 for female 2 are created both sides of the oval rings 25.

Furthermore, aforementioned twist processing steps ST21, ST22 and ST23 is performed by pulling the ring 31 for male 2 and ring 33 for female 3 of the oval rings 25 to the direction away from each other.

[Cutting Binding Portion Step (Step ST24)]

Next, obtain the rings 31 for male 2 and rings 33 for female 3 shown in FIG. 1 by cutting the binding portion 35 shown in FIG. 5 (E).

At this point, the convex portion 2*a* of the rings 31 for male 2 and the convex portion 3*a* of the rings 33 for female 3 are obtained by cutting the binding portion 35, allows the rings 31, 33 to have the appearance image of born (made) from the same one thing.

As described above, in the present embodiment, aforementioned procedure are capable to manufacture the rings 31 for male 2 and rings 33 for female 3 with the design strongly reminiscent concept that the rings 31, 33 are born (made) from the same one thing, Second Embodiment Hereinafter a method for manufacturing a ring in the present embodiment will be explained.

Figure 8A:
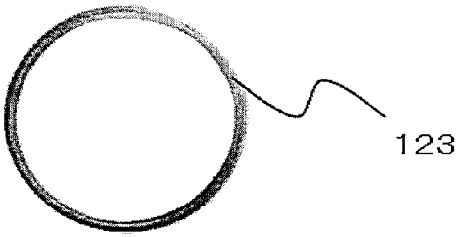
FIG. 8A to FIG. 8E are drawings explaining the ring manufacturing method in the second embodiment of the present invention.
Figure 8B:
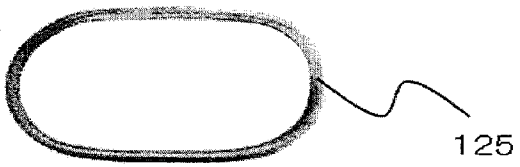

In the present embodiment, form the oval rings 125 shown in FIG. 8B from the circular rings 123 shown in FIG. 8A.

Figure 8C:
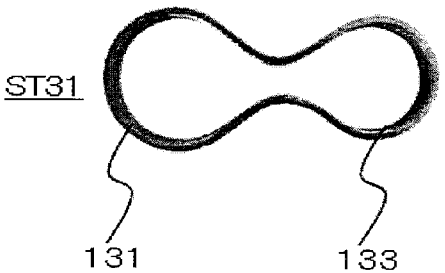
Figure 8D:
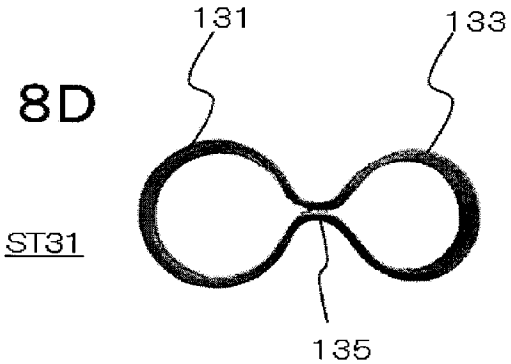

Afterward, as shown in FIG. 8C and FIG. 8D, join by pressing around the center of the longitudinal direction of the oval rings 125 from both sides. And the ring portion for male 131 and the ring portion for female 133 are formed the both sides of the junction.

Figure 8E:
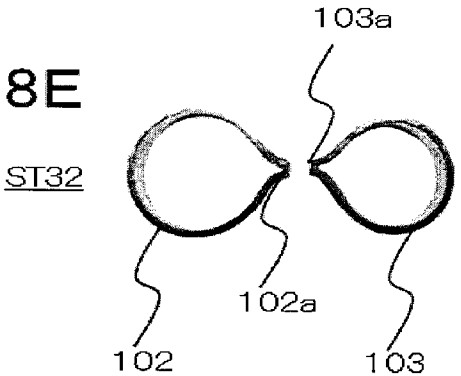

As shown in FIG. 8E, obtain the rings for male 102 and the rings for female 103 by cutting the junction.

Figure 9:
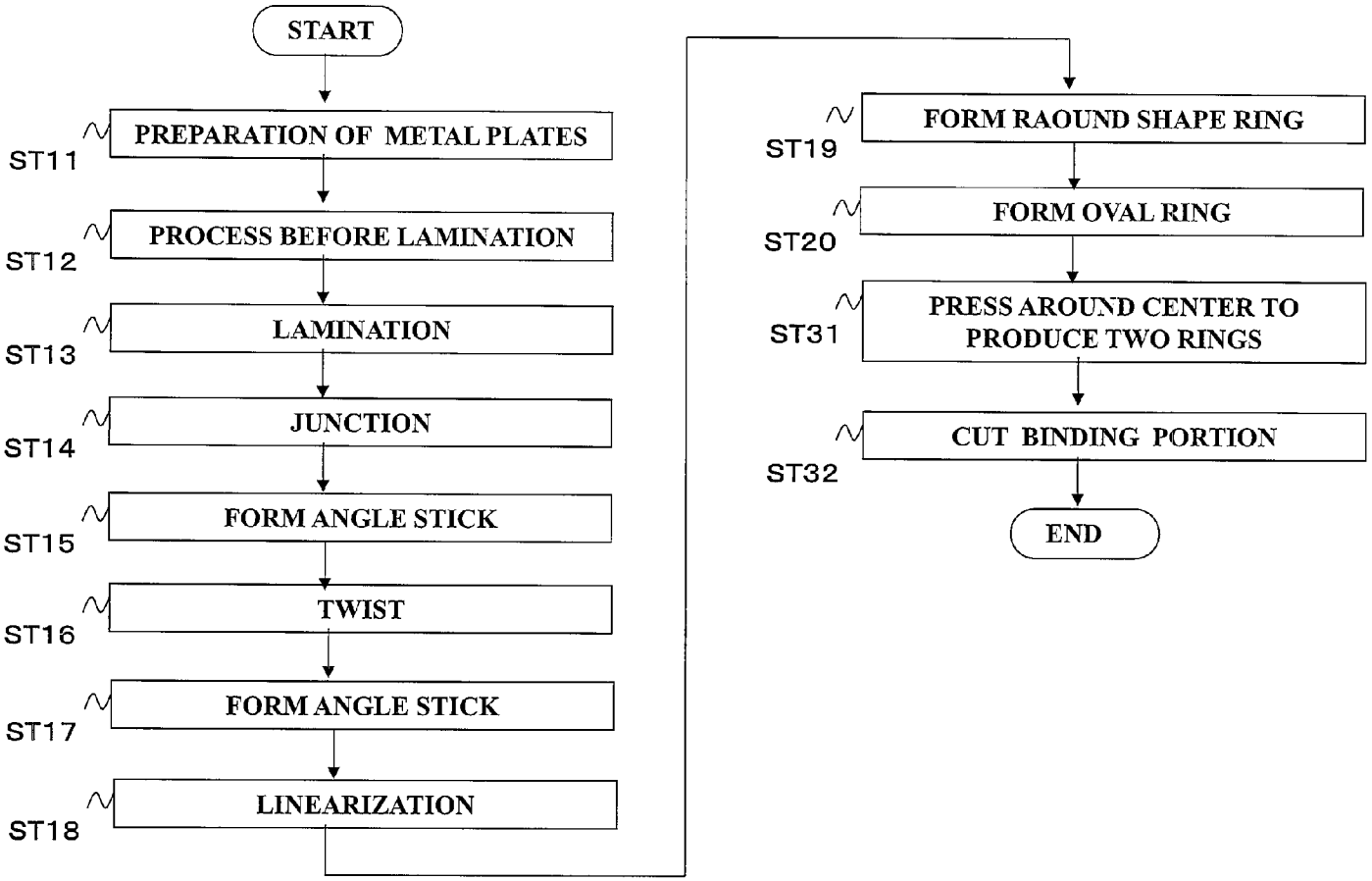
FIG. 9 is a flowchart of the ring manufacturing method relates to the second embodiment of the present invention.

FIG. 9 is a flowchart of a method for manufacturing ring related to the embodiment of the present invention.

All or parts of the steps shown in FIG. 9 are performed by hand or machine.

Steps ST11 to ST20 in FIG. 9 are the same as those described in the first embodiment using FIG. 6.

[Press Around the Center (step ST31)]

As shown in FIG. 8C and FIG. 8D, form a ring portion for male 131 and a ring portion for female 133 at both side of the junction by join a portions near the center by pressing the portions near the center of the long distance direction of the oval rings 125.

[Cutting the Binding Portion (Step ST32)]

As shown in FIG. 8E, obtain the rings 131 for male 102 and the rings 133 for female 103 by cutting the binding portion 135.

At this point, the convex portion 102*a* for the rings 131 of male 2 and the convex portion 103*a* of the rings 133 for female 3 are obtained by cutting the junction, allows the rings 131 for male 102 and rings 133 for female 103 to have the appearance image of born (made) from the same one thing.

As described above, in the present embodiment, by manufacturing the rings for male 102 and the rings for female 103 by aforementioned procedure, the rings for male 2 and rings for female 3 with the design strongly reminiscent concept that the rings 131, 133 are born (made) from the same one thing are manufactured.

This invention is not limited in the embodiment mentioned above. Namely, regarding the component in the embodiment mentioned above, a person skilled in the art can do various changes, combination, sub-combination and substitution in the technical or equivalent scope of this invention.

For example, the present invention is also applicable to the metal pair manufacturing equipment execute aforementioned step using the specific hardware (means).

In aforementioned embodiment, the method of forming two rings from one metal body is exemplified. However present invention is also applicable to the case of forming some goods from the metal body. Ornaments such as rings, pendants, necklaces, earrings, cufflinks, brooches, tie tacks, bangles, buckles, chokers, bracelets and so on are applicable.

Besides the ornaments, for example, knives, swords, spoons, jewelry boxes made of precious metal, vases and basins made of precious metal, compacts, watches and smokers' articles are applicable.

In addition, number and thickness of the metal plate 11 are arbitrary.

INDUSTRIAL APPLICABILITY

This invention is applicable to the ring manufacture method by processing a metal object.

The invention claimed is:

1. A ring manufacturing method comprising:

a ring formation step processing a circular member of a ring shape to form a first ring and a second ring; and a cut step cutting a binding portion at a point between the first ring and the second ring.

2. The ring manufacturing method as set forth claim 1, further comprising:

an oval formation step forming an oval-formed member from the circular member, wherein the ring formation step twists the oval-formed member near a center of a long distance direction and forms the first ring and the second ring on both sides of the binding portion which occurs by the twisting step.

3. The ring manufacturing method as set forth claim 1 wherein the ring formation step twists an oval-formed member formed from the circular member a plurality of times.

4. The ring manufacturing method as set forth claim 1 wherein the ring formation step twists an oval-formed member near a center of a long distance direction while pulling both sides of the oval-formed member to a direction so that the first ring and the second ring separate mutually.

5. The ring manufacturing method as set forth claim 1, further comprising:

an oval formation step forming an oval-formed member from the circular member, wherein the ring formation step joins portions near a center of a long distance direction of the oval-formed member by pressing portions near the center of the long distance direction of the oval-formed member to form the first ring and the second ring at both sides of a conjunction portion, and the cut step cuts the conjunction portion.

6. The ring manufacturing method as set forth claim 5, further comprising:

a lamination step laminating a plurality of metal plates;

a junction step joining the plurality of metal plates laminated in the lamination step by heating;

a twist step twisting the plurality of metal plates joined in the junction step;

a flat step processing the plurality of metal plates into a flat shape after the twist step; and a formation step processing the metal plates formed in the flat step to form a single ring.

* * * * *